US007171752B2

(12) United States Patent
Lee

(10) Patent No.: US 7,171,752 B2
(45) Date of Patent: Feb. 6, 2007

(54) HAIR TRIMMER

(76) Inventor: Ching Lu Lee, No. 13, Lane 319, Sec. 2, Tai Ho Road, Changhua City (TW)

( * ) Notice: Subject to any disclaimer, the term of this patent is extended or adjusted under 35 U.S.C. 154(b) by 177 days.

(21) Appl. No.: 10/971,089

(22) Filed: Oct. 25, 2004

(65) Prior Publication Data

US 2006/0085986 A1 Apr. 27, 2006

(51) Int. Cl.
*B26B 21/00* (2006.01)

(52) U.S. Cl. ..... 30/53; 30/55; 30/75; 30/339

(58) Field of Classification Search ..... 30/339, 30/334, 232, 260, 55, 53, 333, 75, 323
See application file for complete search history.

(56) References Cited

U.S. PATENT DOCUMENTS 880,765 A * 3/1908 Utter ..... 30/332
1,336,969 A * 4/1920 La Rock ..... 30/53
1,368,914 A * 2/1921 Fenwick ..... 30/32
1,932,458 A * 10/1933 Hanson ..... 30/55
2,814,112 A * 11/1957 Gore ..... 30/339
2,828,543 A * 4/1958 Valentine ..... 30/299
3,899,828 A * 8/1975 Bosco ..... 30/151

* cited by examiner

*Primary Examiner*—Timothy V. Eley
*Assistant Examiner*—Isaac N. Hamilton
(74) *Attorney, Agent, or Firm*—Bacon & Thomas

(57) ABSTRACT

A trimmer includes a blade connection portion and a handle, and a blade is engaged with a recess defined in one side of the blade connection portion. A C-shaped clamp has two ridges extending from two insides thereof and the two ridges are slidably engaged with a first groove defined in the other side of the blade connection portion and a second grooves defined in an outside of the pattern block so as to sandwich the blade between the pattern block and the blade connection portion.

6 Claims, 10 Drawing Sheets

HAIR TRIMMER

FIELD OF THE INVENTION

The present invention relates to a hair trimmer using a clamp to slidably hold the pattern block and the blade.

BACKGROUND OF THE INVENTION

A conventional hair trimmer 60 is disclosed in FIGS. 7 and 8, and generally includes a body with a handle and a blade connection portion 62. A finger ring 61 is connected to a distal end of the handle and a recess 64 is defined in a side of the blade connection portion 62. Two positioning protrusions 63 extend from an inside of the recess 64 so that two holes 72 of a blade 70 are mounted onto the positioning protrusions 63. The blade 70 is then positioned in the recess 64 and includes an edge 71 which is exposed beyond a lower edge of the blade connection portion 62. A block 80 has one end with a boss 81 which is pivotably engaged with a notch 65 defined in the inside of the recess 64 so that the block 80 is pivoted to cover the blade 70 and the edge 71 is exposed beyond the lower edge 800 of the block 80 to proceed trimming. An engaging recess 82 is defined in the other end of the block 80 such that when the block 80 is pivoted to cover the blade 70, the engaging recess 82 is engaged with a cooperation portion in the recess 64 to position the block 80. Although the blocks 80 can be replaced so as to have different shapes of lower edges 800, the user might be cut by the edge 71 of the blade 70 when pivoting the block 80.

The present invention intends to provide a trimmer that uses a clamp to hold the pattern block from a top of the blade connection portion to avoid the shortcoming mentioned above.

SUMMARY OF THE INVENTION

The present invention relates to trimmer which comprises a blade connection portion having a first groove defined in a first side of and a handle connected to the blade connection portion. A blade is engaged with the recess and has a cutting edge. A pattern block is attached onto the blade and has a second groove defined in an outside thereof. The cutting edge of the blade is exposed beyond a lower edge of the pattern block. A C-shaped clamp has two ridges extending from two insides thereof and the two ridges are slidably engaged with the first and second grooves to sandwich the blade between the pattern block and the blade connection portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
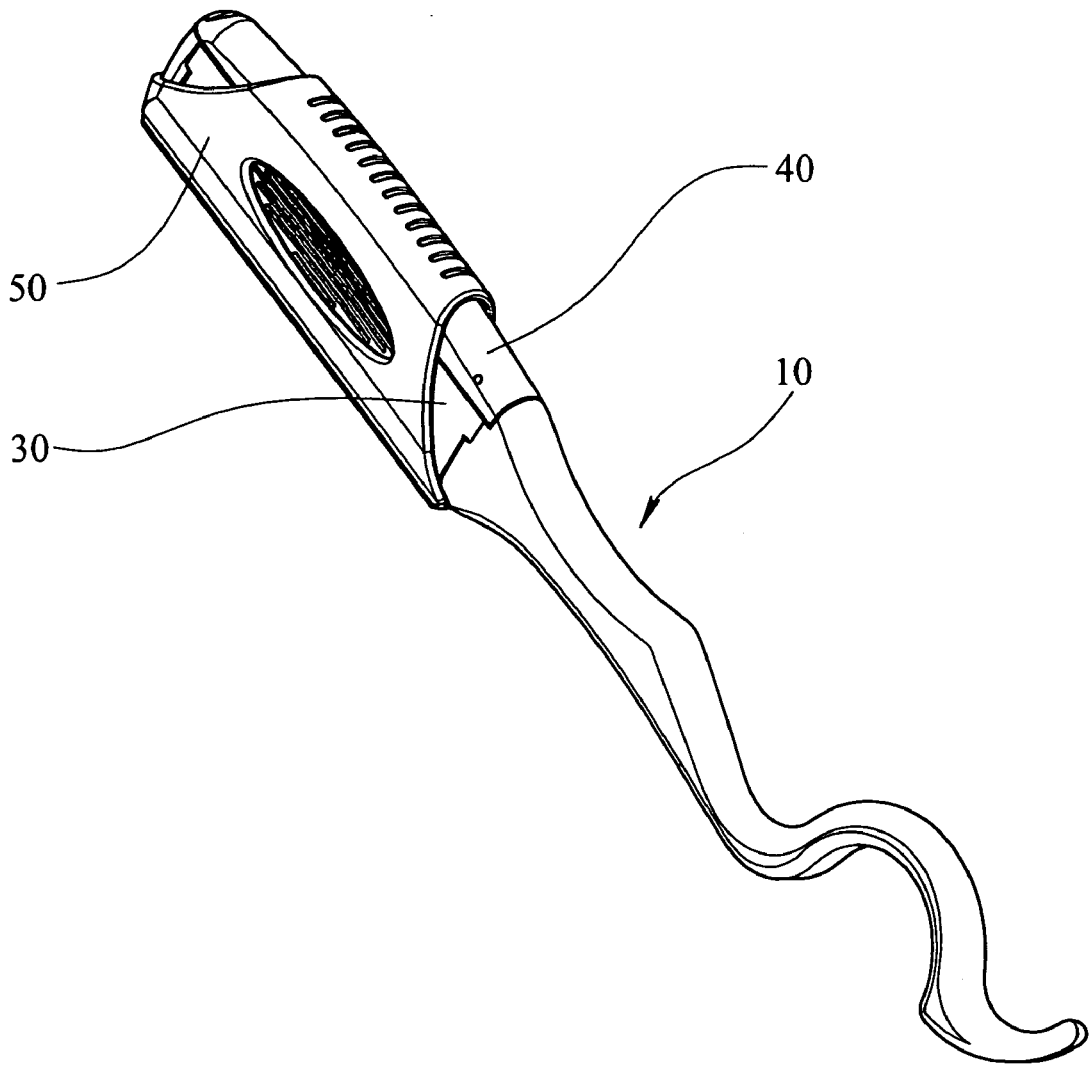
FIG. 1 shows the trimmer of the present invention.
Figure 2:
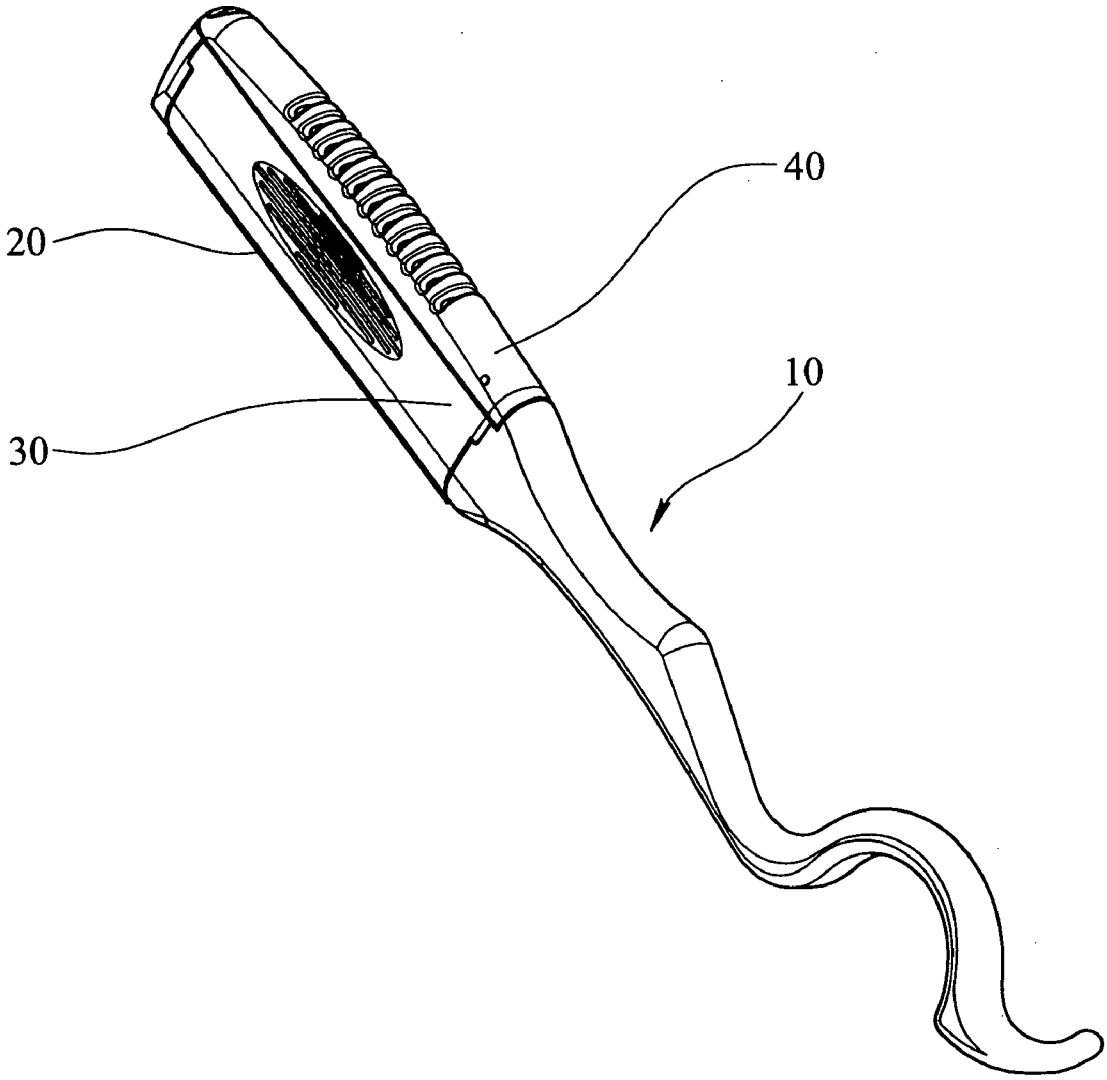
FIG. 2 shows the trimmer of the present invention, wherein the protection sleeve is removed.
Figure 3:
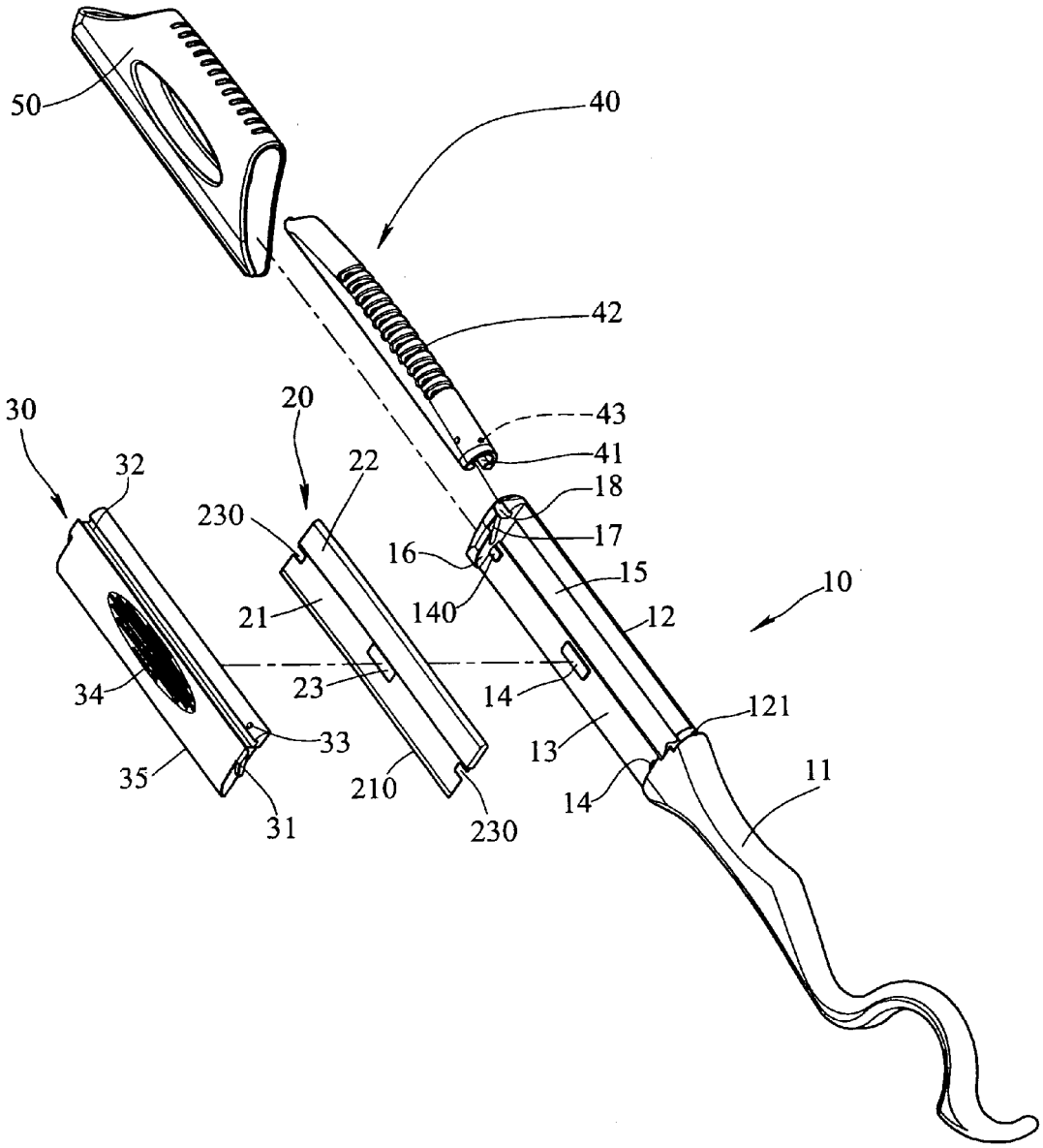
FIG. 3 is an exploded view to show the trimmer of the present invention.
Figure 4:
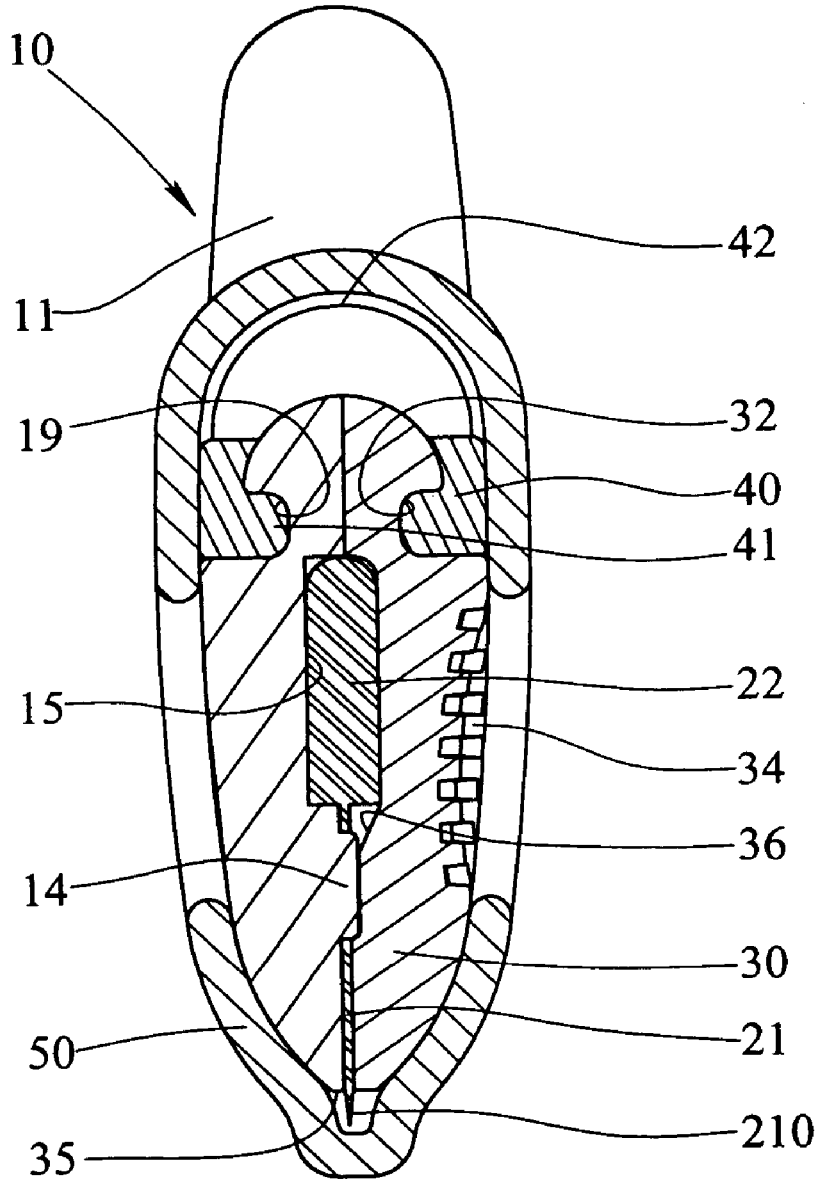
FIG. 4 is a cross sectional end view of the trimmer of the present invention.
Figure 5:
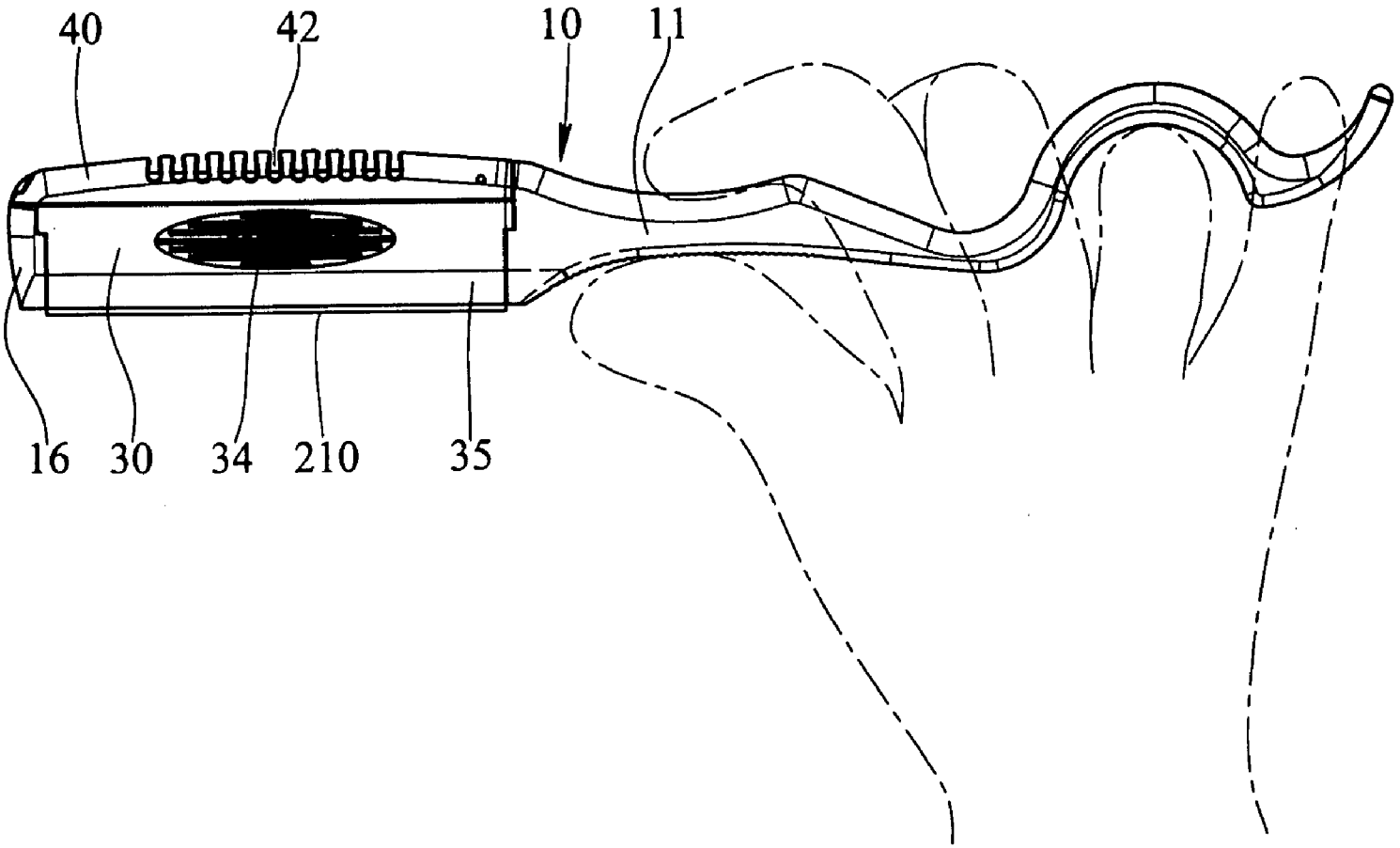
FIG. 5 shows how the user's hand holding the trimmer of the present invention.

Referring to FIGS. 1 to 4, the trimmer 10 of the present invention comprises a blade connection portion 12 and a handle 11 which includes a wave-shaped outer profile and a concavity defined in a bottom of the handle 11 such that the user's hand may conveniently and comfortable hold the handle 11 as shown in FIG. 5. An engaging recess and a first groove 19 are defined in a first side and a second side of the blade connection portion 12. The first and second sides are two opposite sides of the blade connection portion 12. The engaging recess is composed of a deeper recess 15 and a shallow recess 13 as shown. A blade 20 includes a thick portion 22 is blade portion 21 which is connected to the thick portion 22. The thick portion 22 is engaged with the deeper recess 15 and the blade portion 21 is engaged with the shallow recess 13. The blade portion 21 includes a cutting edge 210.

A protrusion 14 extends from an inside of the recess 13 and the blade 20 includes a hole 23 through which the protrusion 14 extends. Two bosses 140 extend from two ends of an inside of the recess 13 and the blade 20 includes two notches 230 defined in two ends of the blade portion 21, the bosses 14 are engaged with the two notches 230. By this connection, the blade 20 is secured in position.

A pattern block 30 is attached onto the blade 20 and has a second groove 32 defined in an outside thereof. The cutting edge 210 of the blade 20 is exposed beyond a lower edge 35 of the pattern block 30. It is noted that the deeper recess 15 is located between two inner end surfaces 16 of the blade connection portion 12 and each inner end surface 16 includes an inclined groove 17. The pattern block 30 has two inclined ribs 31 on two ends thereof and the two inclined ribs 31 are engaged with the inclined grooves 17. An opening 18 is defined in the first side of the blade connection portion 12 and located in alignment with the second groove 32. A rough surface 34 is defined in the outside of the pattern block 30 so as to provide friction when replacing the pattern block 30.

A C-shaped clamp 40 has two ridges 41 extending from two insides thereof and the two ridges 41 are slidably engaged with the first and second grooves 19, 32 to sandwich the blade 20 between the pattern block 30 and the blade connection portion 12. The opening 18 allows the ridge 41 to be slid into the second groove 32. The clamp 40 includes a plurality of slots 42 defined therethrough such that the friction when sliding the clamp 40 to the pattern block 30 and the blade connection portion 12 is reduced due to less contact area. The clamp 40 includes at least two dimples 43 defined in an inside thereof and the pattern block 30 has a positioning boss 33 and another positioning boss 121 extends on a top of the blade connection portion 12, such that the two positioning bosses 33, 121 are engaged with the at least two dimples 43 of the clamp 40 to farther position the clamp 40.

A protection sleeve 50 is slidably mounted to the blade connection portion 12 and covers the cutting edge 210 of the blade 20 when the trimmer 10 is not in use.

Figure 6A:
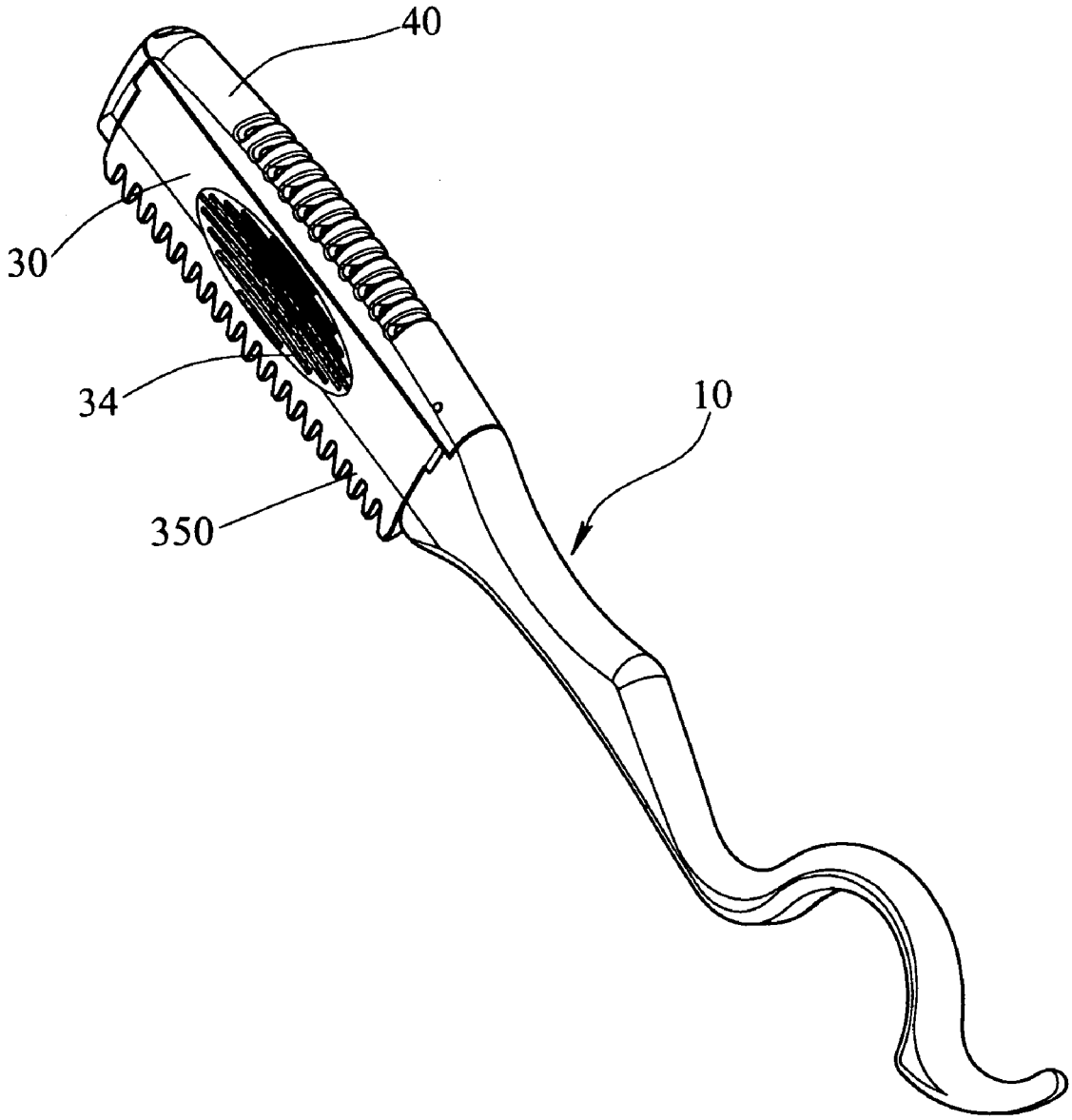
FIGS. 6A to 6C show different lower edges of the pattern blocks of the trimmer of the present invention.
Figure 6B:
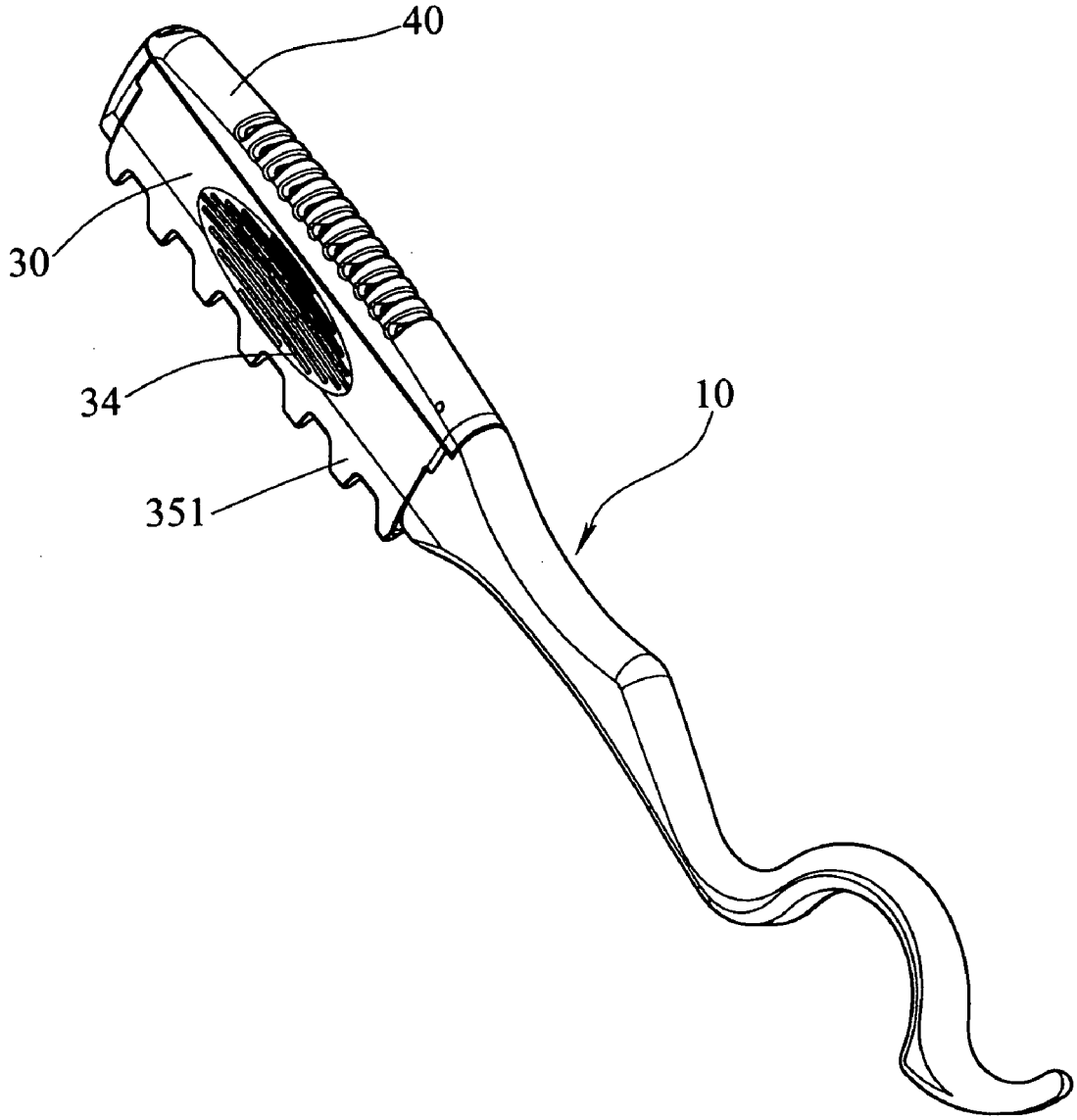
Figure 6C:
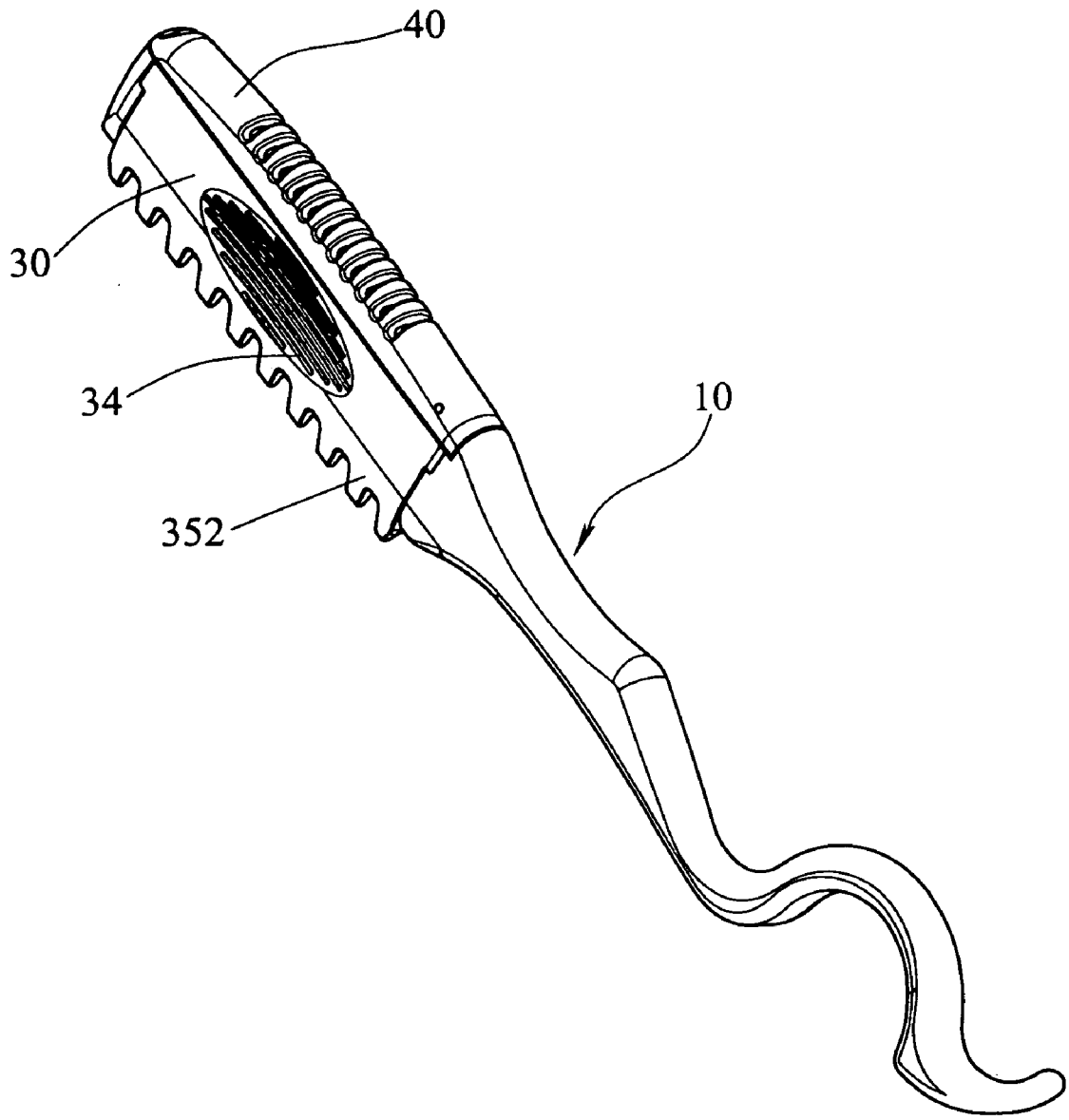
Figure 7:
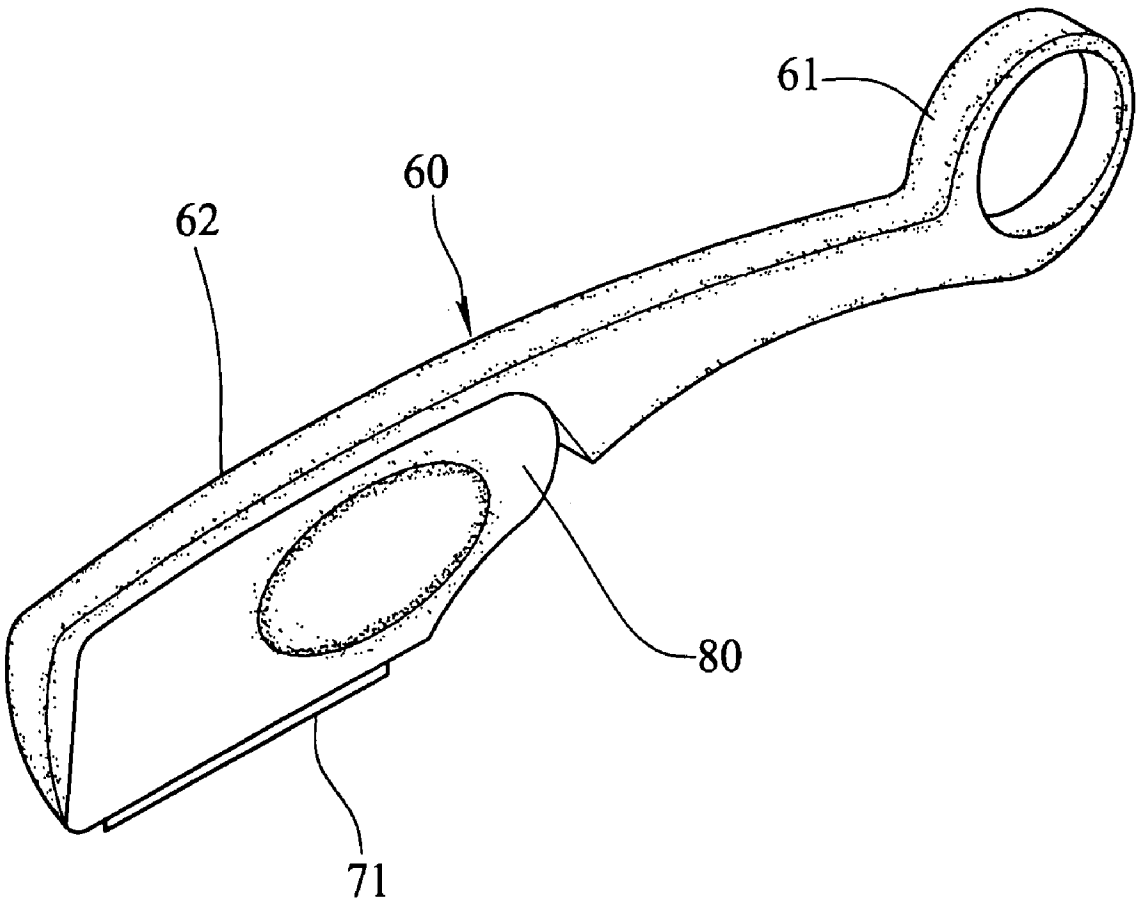
FIG.7 PRIOR ART
FIG. 7 shows a prior art conventional trimmer.
Figure 8:
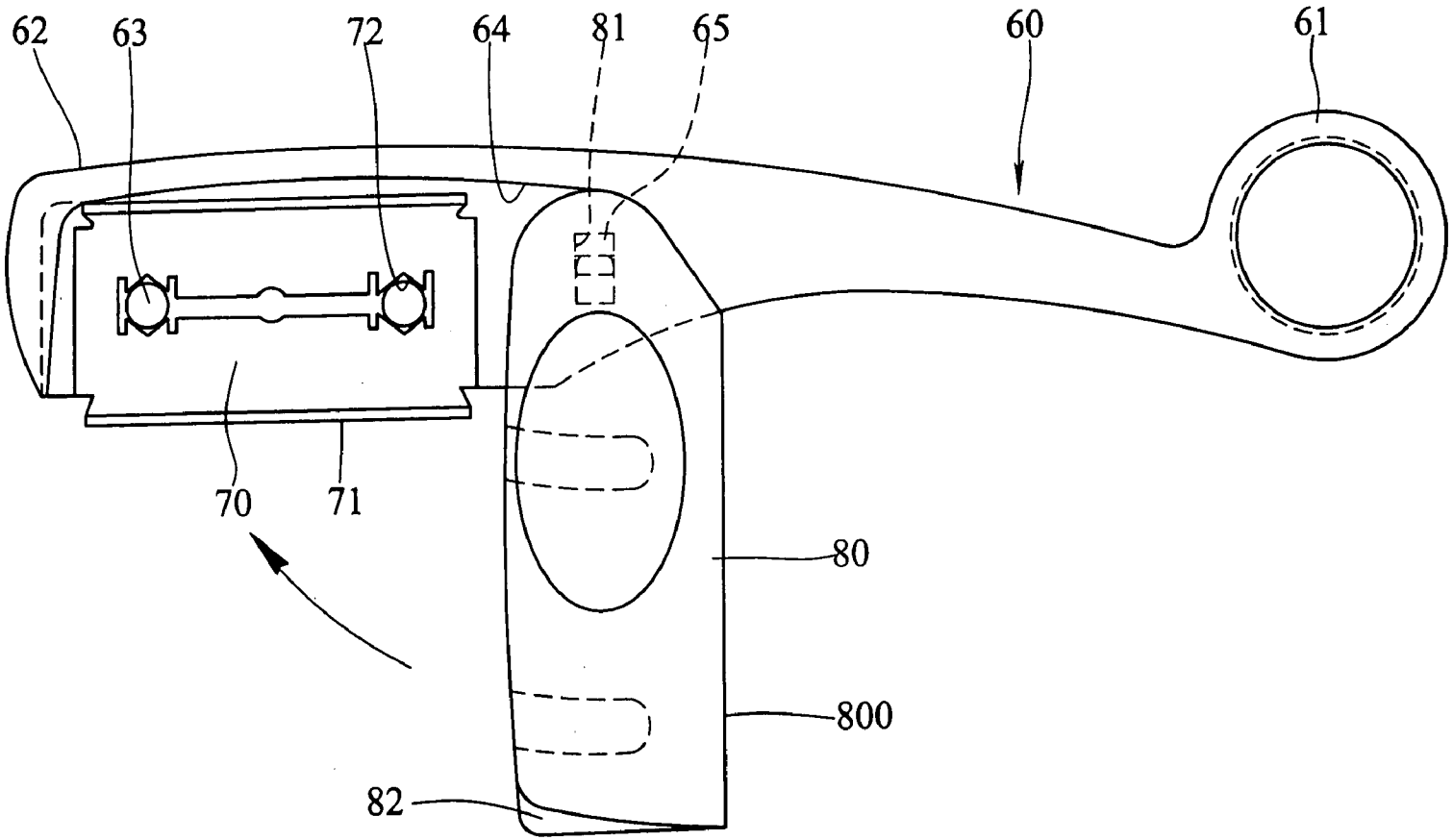
FIG.8 PRIOR ART
FIG. 8 shows the pattern block is pivoted away from the blade of the prior art conventional trimmer.

FIGS. 6A to 6C show different shapes of the lower edges 350, 351 and 352 of the pattern blocks 30 of the trimmer 10 to meet different needs of use.

While we have shown and described the embodiment in accordance with the present invention, it should be clear to those skilled in the art that further embodiments may be made without departing from the scope of the present invention.

What is claimed is:

1. A trimmer (10) comprising:

a blade connection portion (12) and a handle (11), a recess and a first groove (19) defined in two opposite sides of the blade connection portion (12), the recess (15) located between two inner end surfaces (16) of the blade connection portion (12) and each inner end surface (16) including an inclined groove (17);

a blade (20) engaged with the recess and having a cutting edge (210);

a pattern block (30) attached onto the blade (20) and having a second groove (32) defined in an outside thereof, and the cutting edge (210) of the blade (20) being exposed beyond a lower edge (35) of the pattern block (30), the pattern block (30) having two inclined ribs (31) on two ends thereof and the two inclined ribs (31) engaged with the inclined grooves (17); and a C-shaped clamp (40) having two ridges (41) extending from two insides thereof and the two ridges (41) being slidably engaged with the first and second grooves (19, 32) to sandwich the blade (20) between the pattern block (30) and the blade connection portion (12).

2. The trimmer as claimed in claim 1, wherein a protrusion (14) extends from an inside of the recess (13) and the blade (20) includes a hole (23) through which the protrusion (14) extends.

3. The trimmer as claimed in claim 1, wherein two bosses (140) extend from two ends of an inside of the recess (13) and the blade (20) includes two notches (230) defined in two ends thereof, the bosses (140) engaged with, the two notches (230).

4. The trimmer as claimed in claim 1, wherein the clamp (40) includes a plurality of slots (42) defined therethrough.

5. The trimmer as claimed in claim 1, wherein the clamp (40) includes at least two dimples (43) defined in an inside thereof, the pattern block (30) having a positioning boss (33) and another positioning boss (121) extending on a top of the blade connection portion (12), the two positioning bosses (33, 121) engaged with the at least two dimples (43) of the clamp (40).

6. The trimmer as claimed in claim 1, wherein a protection sleeve (50) is slidably mounted to the blade connection portion (12) and covers the cutting edge (210) of the blade (20).

* * * * *